US005188681A

United States Patent [19]

Teraoka et al.

[11] Patent Number: 5,188,681

[45] Date of Patent: Feb. 23, 1993

[54] PROCESS FOR MANUFACTURING THIN STRIP OR SHEET OF CR-NI-BASE STAINLESS STEEL HAVING EXCELLENT SURFACE QUALITY AND MATERIAL QUALITY

[75] Inventors: Shinichi Teraoka; Masanori Ueda, both of Kitakyushu; Toshiyuki Suehiro, Hikari, all of Japan

[73] Assignee: Nippon Steel Corporation, Tokyo, Japan

[21] Appl. No.: 761,920

[22] PCT Filed: Jan. 17, 1991

[86] PCT No.: PCT/JP91/00042

§ 371 Date: Sep. 12, 1991

§ 102(e) Date: Sep. 12, 1991

[87] PCT Pub. No.: WO91/10517

PCT Pub. Date: Jul. 25, 1991

[30] Foreign Application Priority Data

Jan. 17, 1990 [JP] Japan ..... 2-6371
Mar. 31, 1990 [JP] Japan ..... 2-83024

[51] Int. Cl.[5] ..... C21D 8/02

[52] U.S. Cl. ..... 148/603; 148/606; 148/641; 148/546; 148/506

[58] Field of Search ..... 148/2, 12 E, 506, 541, 148/546, 603, 606

[56] References Cited

U.S. PATENT DOCUMENTS 5,045,124 9/1991 Suehiro et al. ..... 148/2

FOREIGN PATENT DOCUMENTS 0378705 7/1990 European Pat. Off. .
0387786 9/1990 European Pat. Off. ..... 148/2
55-77962 6/1980 Japan .
62-130749 6/1987 Japan .
63-216924 9/1988 Japan .
64-11925 1/1989 Japan .

OTHER PUBLICATIONS

Patent Abstracts of Japan, vol. 12, No. 128 (C-489) Apr. 20, 1988.
Patent Abstracts of Japan, vol. 14, No. 571, (C-0790) Dec. 19, 1990.
Patent Abstracts of Japan, vol. 12, No. 18 (M-660), Jan. 20, 1988.
European Search Report EP 91 90 2761.
"Tetsu-to-Hagane", 1985, A197-A256 (English Version Attached).

*Primary Examiner*—Deborah Yee
*Attorney, Agent, or Firm*—Kenyon & Kenyon

[57] ABSTRACT

A process for manufacturing a thin sheet of a Cr-Ni-base stainless steel having an excellent surface quality and material quality, which comprises casting a cast strip having a thickness of 6 mm or less from a Cr-Ni-base stainless steel including 18% Cr-8% Ni steel by a continuous casting wherein a casting mold is moved synchronously with the cast strip, and subjecting the cast strip to cold rolling to form a thin sheet product, wherein the cast strip immediately after the casting is coiled at a temperature of 800° to 1200° C. and subjected to cold rolling and final annealing to form a thin sheet product.

5 Claims, 6 Drawing Sheets

×100

×100

×100

PROCESS FOR MANUFACTURING THIN STRIP OR SHEET OF CR-NI-BASE STAINLESS STEEL HAVING EXCELLENT SURFACE QUALITY AND MATERIAL QUALITY

DESCRIPTION

1. Technical Field

The present invention relates to a process for manufacturing a thin strip or sheet of a Cr-Ni-base stainless steel, which comprises casting a cast strip having a thickness close to that of a product, by the synchronous continuous casting process wherein a casting mold is moved synchronously with a cast strip, and cold-rolling the strip.

2. Background Art

A thin sheet of a stainless steel is currently manufactured by a continuous casting process, which comprises casting a cast slab having a thickness up to about 100 mm while oscillating a casting mold in the direction of casting, surface-treating the slab, heating the treated slab to a temperature of 1000° C. or above in a heating furnace, hot-rolling the heated slab by using a hot-strip mill comprising rough-rolling stands and finish-rolling stands to form a hot-strip having a thickness of several millimeters, cold-rolling the hot-strip, and subjecting the cold-rolled strip to necessary treatments, such as annealing, pickling and skin-pass rolling, to form a cold-rolled product.

Before the cold-rolling, the hot-strip obtained by the hot-rolling is annealed to soften the hot-strip, which is in a work-hardened state due to heavy hot working, thereby ensuring the shape (flatness), material quality (grain size and mechanical properties), and surface quality (prevention of roping) required of a final product, and further, is pickled and ground to remove oxide scale present on the surface thereof.

The above-described conventional process requires lengthy facilities for hot-rolling and a vast amount of energy is consumed for heating and working the material, and thus the conventional process is not considered an optimum manufacturing process, from the viewpoint of productivity.

Further, since a texture developed during the hot working firmly remains in the final sheet product, the press working of the product sheet in the user is subjected to many limitations, such as the need to take into consideration the anisotropy attributable to the texture.

Accordingly, a process wherein the continuous casting step is directly connected to the cold-rolling step without the hot-rolling step is now under development, to thereby avoid the need to provide lengthy facilities and use a vast amount of energy for manufacturing a hot-strip through the hot-rolling of a cast strip having a thickness of 100 mm or more, and at the same time, eliminate the limitations on the use of the product derived from the hot worked texture. Specifically, in this process, a cast strip (a thin strip) having a thickness equivalent or close to that of the hot-strip obtained by the conventional hot-rolling is continuously cast, and the thin cast strip is cold-rolled. Such a process is described in, for example, special reports in "Tetsu-to-Hagane", vol. 85, 1985, pages A197 to A256.

The thin sheet product manufactured by the above-described continuous casting/cold-rolling process (hereinafter referred to as "strip continuous casting"), however, has a finer grain structure than that of the thin sheet product manufactured by the conventional continuous casting/hot-rolling/cold-rolling process (hereinafter referred to as "conventional process"), which causes the elongation to be lowered, whereby the workability during a press working or the like by the user is unfavorably lowered. This phenomenon is reported in, for example, "CAMP ISIJ, vol. 1, 1988, 1670–1705. In this report, the annealing of the cast strip to cause δ-ferrite remaining in the cast strip to disappear is described as a countermeasure.

Detailed studies conducted by the present inventors on the Cr-Ni-base stainless steel manufacturing process by strip continuous casting have revealed that the presence of δ-ferrite and fine MnS remaining in the cast strip inhibits the growth of recrystallized grains during the cold-rolling and annealing and is a cause of the formation of the fine structure and the lowering in the elongation of the final product. Therefore, to eliminate the lowering in the elongation of the product manufactured by the strip continuous casting, it is necessary to cause the δ-ferrite to disappear, and at the same time, to conduct a heat treatment for a sufficient coarsening of the MnS.

The δ-ferrite can be made to disappear through the annealing of the cast strip. In the annealing for a short period of time conducted for the conventional hot-rolled steel strip of an austenitic stainless steel, however, a sufficient transformation into a γ phase cannot be attained, and thus it becomes necessary to conduct annealing at a high temperature for a long period of time, which renders this method very disadvantageous from the viewpoints of productivity and production costs. Accordingly, the development of a more efficient method of heat treating the strip, and a method of enhancing the rate at which the δ-ferrite is made to disappear during the heat treatment, is desired in the art.

The MnS finely precipitated in the cast strip exhibits a stronger inhibiting of the grain growth of the cold-rolled annealing sheet than the δ-ferrite, and thus it is necessary to precipitate MnS in a sufficiently coarse form in the stage of the cast strip, to render the MnS harmless. In the method wherein the cast strip is reheated and annealed, it is necessary to conduct a heat treatment at a high temperature for a long period of time, and accordingly, a method which enables the heat treatment at a high temperature for a long period of time to be efficiently conducted, and facilitates the grain growth, is desired in the art.

The SUS304 thin sheet product manufactured by the strip continuous casting has another problem; specifically, the problem resides in the occurrence of fine uneven portion (roping) on the surface of the cold-rolled sheet. The roping is a phenomenon attributable to the large γ grain diameter, and accordingly, it was necessary to inhibit the occurrence of roping by refining the γ grain of the cast strip.

DISCLOSURE OF THE INVENTION

An object of the present invention is to provide a process for manufacturing a thin strip or sheet of a Cr-Ni-base stainless steel having an excellent workability and surface quality, comprising casting a cast strip having a size close to the thickness of a final product by a synchronous continuous casting process in which no difference exists in the relative speed of the cast strip and the mold wall, and subjecting the cast strip to cold-rolling, wherein the growth of recrystallized grain is promoted during the cold-rolling annealing while inhibiting the occurrence of roping through a control of the casting atmosphere, components, and the temperature of the cast strip during the period between completion of the casting and during the coiling.

According to the first invention of the present application, the above-described object can be attained by a process for manufacturing a thin strip or sheet of a Cr-Ni-base stainless steel having an excellent surface quality and material quality, which comprises casting a cast strip having a thickness of 6 mm or less from a Cr-Ni-base stainless steel including 18%Cr-8%Ni steel by a continuous casting wherein a casting mold is moved synchronously with the cast strip, and subjecting the cast strip to cold-rolling to form a thin sheet product, characterized in that the cast strip immediately after the casting is coiled at a temperature of 800° to 1200° C. and subjected to cold-rolling and final annealing to form a thin sheet product.

In the above-described first invention, the present inventors found that the δ-ferrite is caused to disappear more rapidly by conducting the casting in a state such that the percentage solid phase of the cast sheet at the time of release from the casting mold is high.

In the second invention of the present application, to ensure the surface quality and material quality of the product in the process for manufacturing a thin strip or sheet of a Cr-Ni-base stainless steel, such as SUS304, by strip continuous casting, there are provided a method of refining the γ grain of the cast strip and a method of efficiently conducting a heat treatment for reducing the δ-ferrite remaining in the cast strip and precipitating the MnS in a sufficiently coarse form.

Specifically, the present inventors studied conditions which provide a combination of the material (elongation) of the thin sheet with the surface quality (roping), and as a result, found that the γ grain of the cast strip can be refined through the control of casting and solidification atmosphere, and the γ grain of the cast strip is further refined through the control of the main components, and found that the combination of the material (elongation) with the surface quality (roping) of the thin sheet can be attained by holding the cast strip at a high temperature.

The second invention of the present application consists in a process for manufacturing a thin strip or sheet of a Cr-Ni-base stainless steel, which comprises casting a cast strip having a thickness of 6 mm or less from a Cr-Ni-base stainless steel including 18%Cr-8%Ni steel and subjecting the cast strip to cold-rolling to form a thin sheet product, characterized in that the steel is cast and solidified in an atmosphere mainly composed of nitrogen or helium under a condition of a δ-Fe cal (%) of 0 to 10%, this δ-Fe cal (%) being defined by the equation δ-Fe cal (%)=3(Cr+1.5Si+Mo+Nb+Ti)−2.8(Ni+0.5Mn+0.5Cu)−84 19.8 (%), to thereby form a δ phase as a primary crystal in the solidification, and at the same time, lower the initiation temperature of crystallization or precipitation of the γ phase to inhibit the growth of the γ grain during and after the solidification; held at a temperature in the range of 800° to 1250° C. to precipitate MnS in a coarse grain form, and at the same time, to reduce the δ ferrite; and then subjected to cold-rolling and final annealing according to the conventional procedure.

BEST MODE OF CARRYING OUT THE INVENTION

First the principle of the first invention of the present application will be described, with reference to the accompanying FIGS. 1 and 2.

Figure 1:
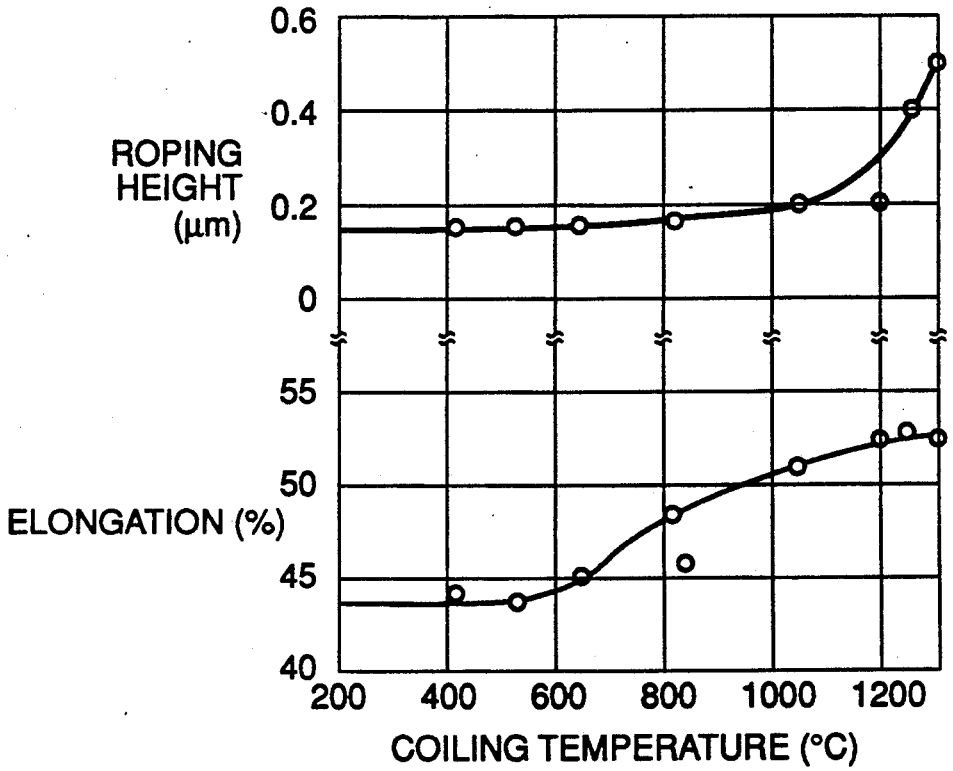
FIG. 1 is a graph showing the relationship between the coiling temperature of a cast strip and the roping height and elongation of a thin sheet product.

FIG. 1 shows a representative example of the relationship between the coiling temperature immediately after the casting and the roping height and elongation of a final cold-rolled product with respect to a JIS SUS304 stainless steel cast strip (thickness: 2 mm) cast according to continuous casting in a twin drum system. As apparent from FIG. 1, to cause the δ ferrite to sufficiently disappear and attain a satisfactory elongation (48% or more) from the practical point of view, it is necessary to coil the cast strip at a temperature of 800° C. or above. To maintain the roping height at a value that does not cause a problem in practical use (not higher than 0.2 μm) through the inhibition of the growth of γ grain during the coiling of the cast strip, the coiling temperature must be 1200° C. or below. It has been confirmed that the thin sheet product manufactured from the cast strip coiled in this temperature region has satisfactory material quality (elongation) and surface quality (prevention of roping) from the practical viewpoint.

Further, the δ ferrite remaining in the cast strip must have a composition such that it is so unstable as to be easily transformed into a γ phase in this coiling temperature region. Accordingly, it is necessary to conduct a rapid cooling solidification which can prevent ferrite stabilizing elements (Cr, Si, Mo, Ti, etc.) from concentrating in the δ ferrite, and it is important that the percentage solid phase at the time of a release of the cast strip from the casting mold wall is 65% or more, and that the proportion of an equiaxed crystal portion (a portion wherein the solidification rate is slower than the columnar crystal portion and the stabilization of the δ ferrite is advanced) is reduced after the release of the cast strip from the casting mold.

In view of the above, the present inventors cast thin cast strips under various casting conditions and studied various factors associated with the speed at which the δ ferrite disappears, and as a result, found that the speed of the disappearance of the δ ferrite is greatly influenced by the solidified structure of the cast strip. Namely, it was apparent that, under the same cast strip annealing conditions, the columnar crystal portion, which is a rapid cooling-solidified structure, in the cast strip exhibits an considerably higher δ ferrite disappearance speed than that of the equiaxed crystal portion.

Figure 2:
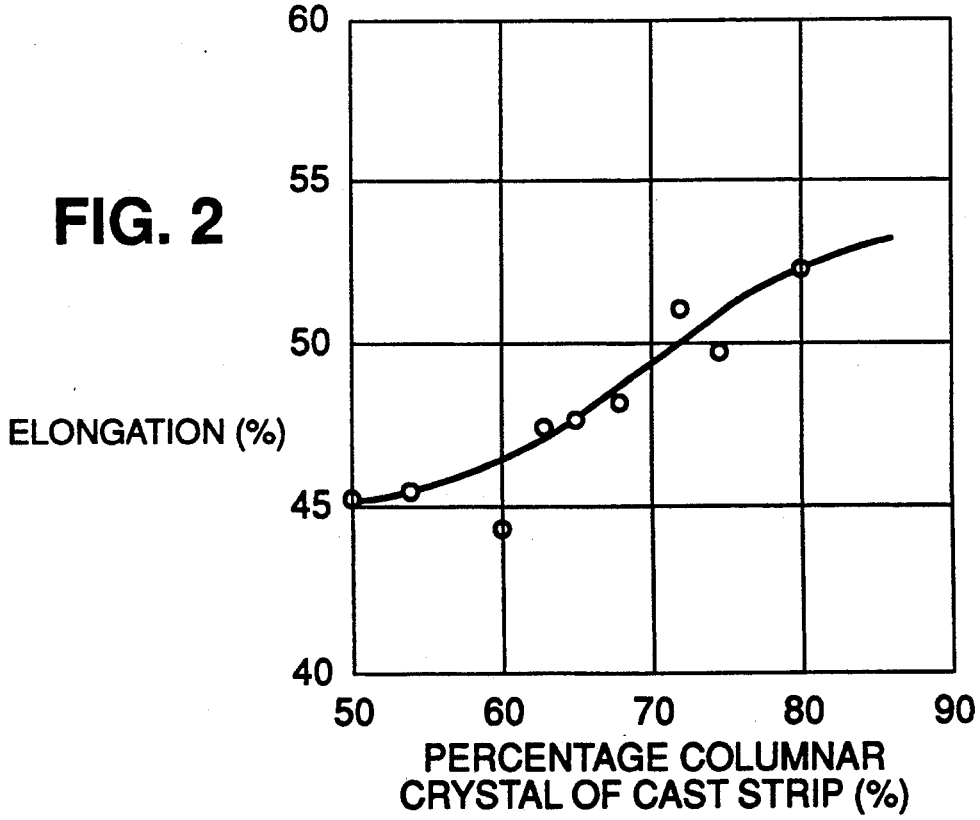
FIG. 2 is a graph showing a representative example of the relationship between the percentage columnar crystal of a cast strip and the elongation of a thin sheet product.

FIG. 2 shows a representative example of the results of a measurement of the elongation of thin sheet products manufactured from strips prepared by casting a JIS SUS304 stainless steel under various casting conditions, to form cast strips having different proportions of columnar crystal (percentage columnar crystal) in the solidified structure of the cast strip, and annealing the resultant cast strips under the same condition (800° C.×60 min). As apparent from this drawing, the elongation of the thin sheet products increases with an increase in the percentage columnar crystal of the cast strip, and optimum elongation value can be obtained particularly when the percentage columnar crystal is 65% or more. Specifically, it is preferable to eliminate the δ ferrite by coiling the cast strip at a high temperature, and at the same time, to make the percentage solid phase 65% or more, to thereby increase the disappearing speed of the δ ferrite, and thus cause the δ ferrite to disappear in a short time even when annealing at a lower temperature.

The principle of the second invention of the present application will now be described with reference to the accompanying FIG. 3, 4 and 5.

The present inventors investigated heat treating conditions for reducing the δ ferrite and precipitating MnS in a coarse grain form, and as a result, found that the heat treatment at a temperature in the range of 1250° C. to 800° C. of a cast strip immediately after the casting causes the δ ferrite to disappear and the MnS to be precipitated in a coarse grain form, in a short time with a high efficiency. When the cast strip is held at 1200° to 1000° C., a subsequent cooling at a rate of 50° C./sec or more in a temperature region from 1000° to 550° C. prevents the precipitation of carbides, and thus it becomes possible to omit the step of heat-treating the cast strip for converting the carbides to a solid solution.

Further, with respect to the refinement of the γ grain, it has been found that the use of a casting and solidification atmosphere mainly composed of nitrogen or helium causes a fine chill crystal to remain on the surface layer of the cast strip, and at the same time, the γ grain diameter of the cast strip becomes smaller than that of the cast strip cast in an argon atmosphere over the whole thickness of the cast strip.

Figure 3A:
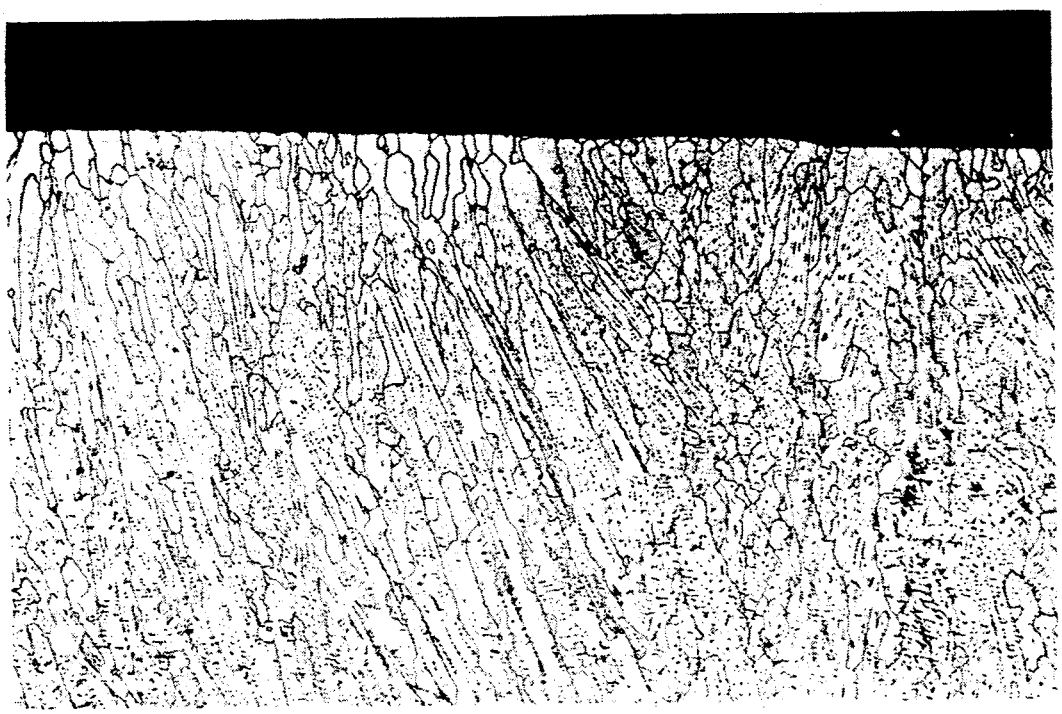
FIG. 3 is a photomicrograph showing a metallic structure of a thin cast strip prepared by a continuous casting process, wherein (*a*) is a microphotograph showing a metallic structure of a thin cast strip prepared by the process of the present invention and (*b*) and (*c*) are microphotographs prepared by the comparative process.
Figure 3B:
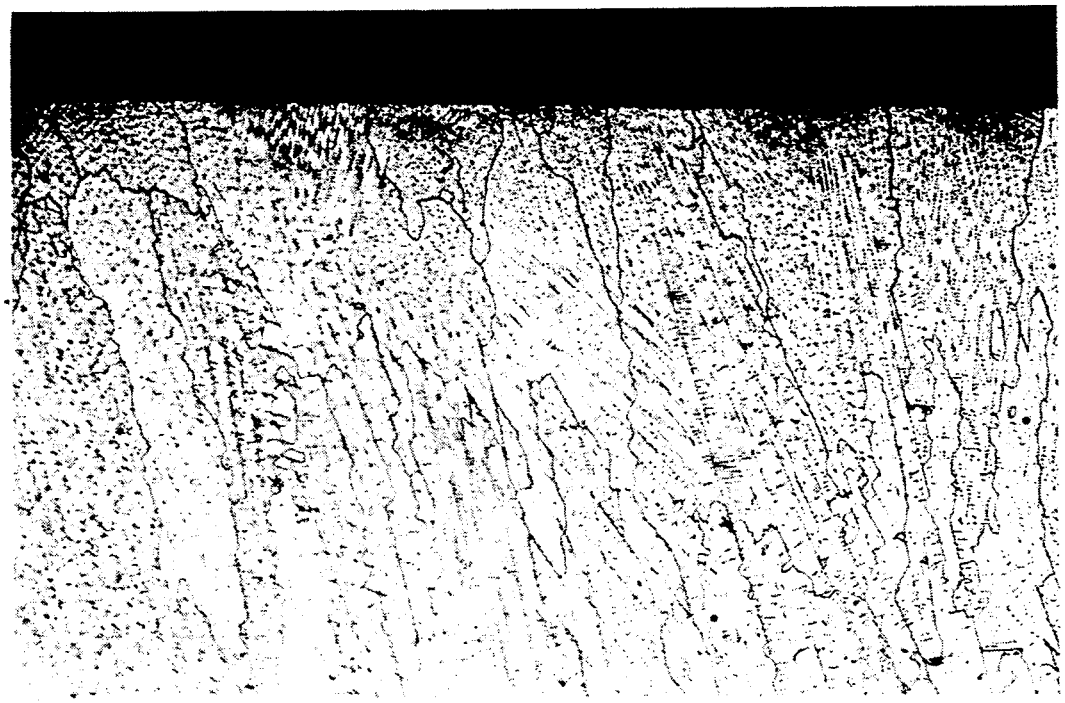
Figure 3C:
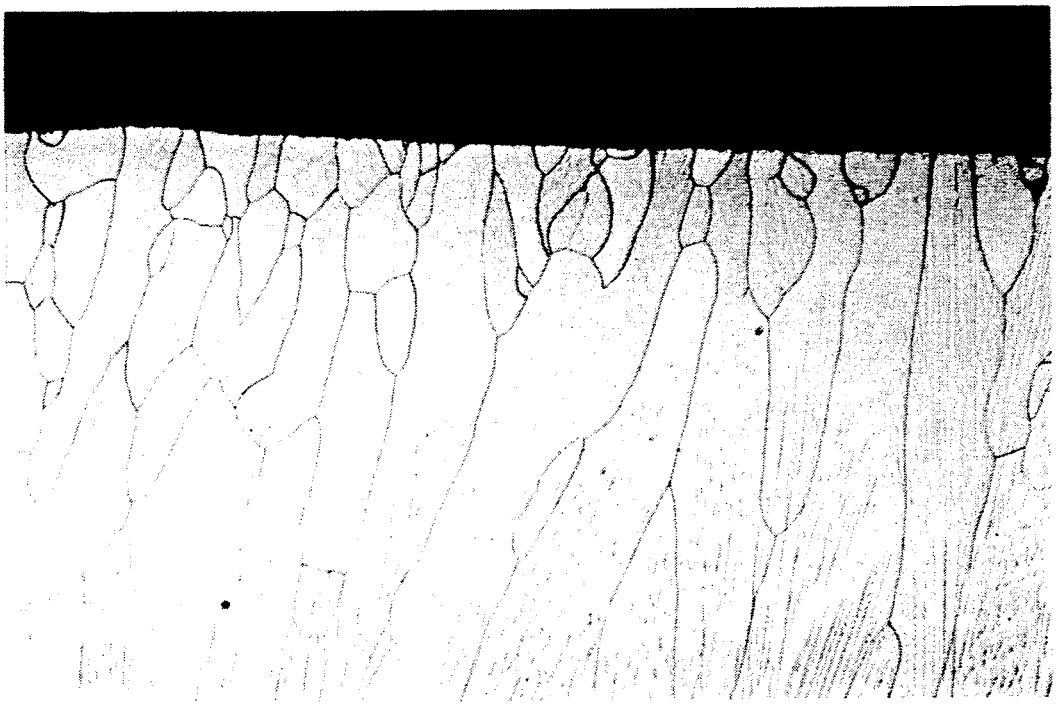

FIG. 3 (*a*) is a microphotograph of a metallic structure of a cast strip formed by casting a molten steel having δ-Fe cal value of 3.1% in a nitrogen atmosphere, and FIG. 3 (*b*) is a microphotograph of a metallic structure of a cast strip formed by casting a molten steel having δ-Fe cal value of 3.5% in an argon atmosphere. As apparent from the comparison of these structures, the structure shown in FIG. 3 (*a*) is finer.

Further, the present inventors found that the γ grain diameter of the cast strip becomes smaller when the δ-Fe cal value defined by the equation δ-Fe cal= $3(Cr+1.5Si+Mo)-2.8(Ni+0.5Cu+0.5Mn)-84(C+N)-19.8$ is made 0 to 10%. FIG. 3 (*c*) is a microphotograph of a metallic structure of a cast strip formed by casting a molten steel having δ-Fe cal value of −2.1% in a nitrogen atmosphere, and as seen in this figure, the γ grain diameter of the cast strip is obviously larger than that of the cast strip shown in FIG. 3 (*a*).

Figure 4:
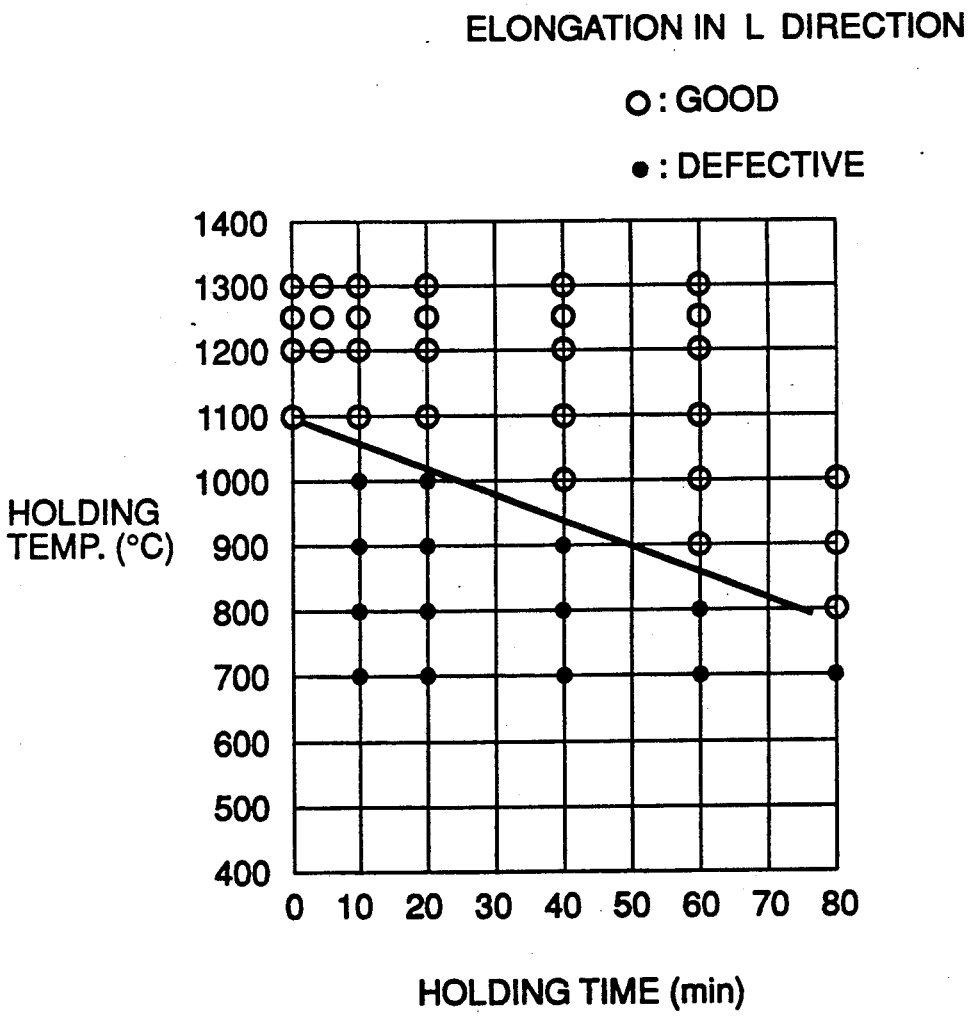
FIG. 4 is a graph showing the elongation in the L direction where a cast strip prepared according to the process of the present invention is held immediately after the casting at a temperature in the range of 700° to 1300° C. for 1 to 80 min.
Figure 5:
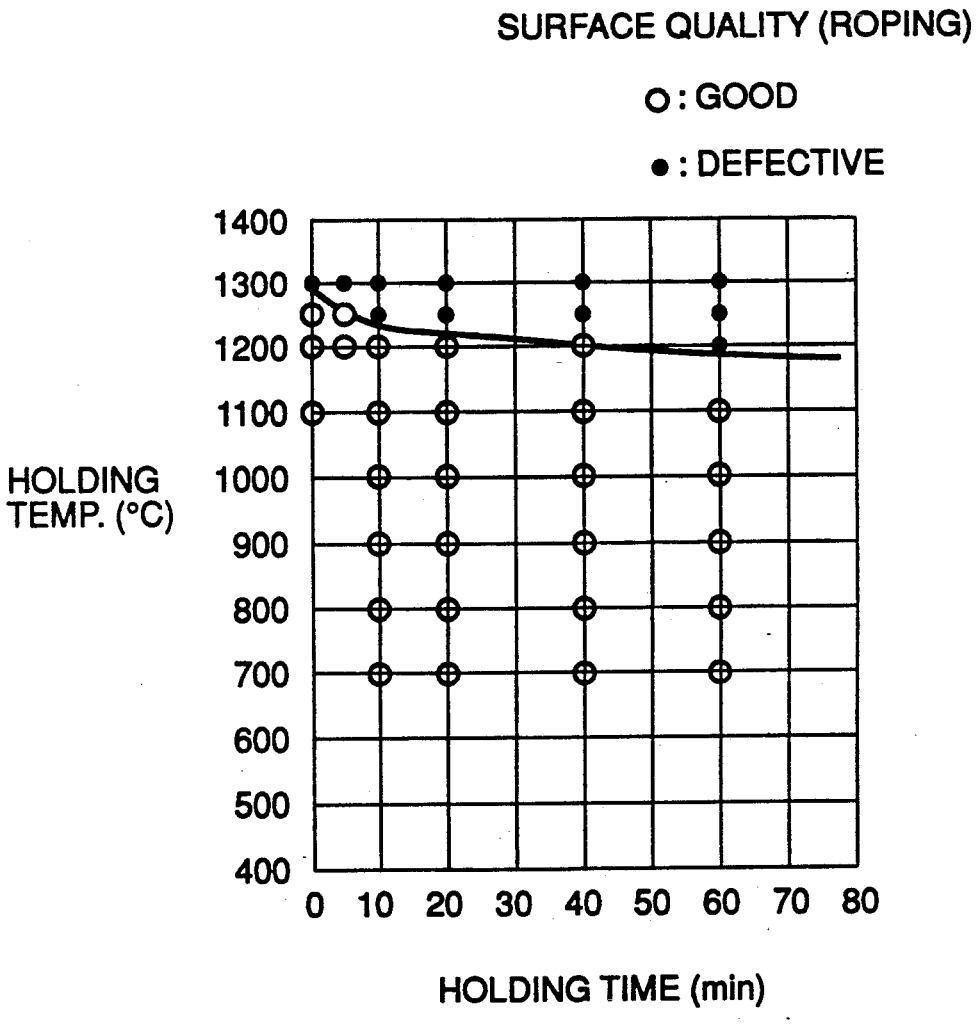
FIG. 5 is a graph showing the state of roping where a thin cast strip cast according to the process of the present invention is held under the same condition as in the case of FIG. 4.

FIGS. 4 and 5 are diagrams showing the relationship between the holding conditions at 1300° to 800° C. immediately after the casting of a strip (thickness: 2 mm) of a JIS304 stainless steel cast in a nitrogen atmosphere, by a continuous casting machine having a twin drum system, and the elongation and roping of the final product. When the cast strip is maintained at a high temperature for a long period of time, the grain grows during the cold-rolled annealing and exhibits a good elongation due to a reduction in the amount of the δ ferrite and the precipitation of MnS. When the cast strip is held at a temperature of more than 1250° C., however, the γ grain grows even in a short time, and thus roping occurs. Therefore, to manufacture a thin sheet product having an excellent surface quality and material quality, it is necessary to maintain the cast strip at a temperature in the range of 1250° to 800° C., for 80 min or less.

The present invention will now be described in more detail by way of the following Examples.

EXAMPLE 1

Thin sheets of Cr-Ni-base stainless steels were manufactured according to the first invention of the present application.

Various austenitic stainless steels comprising 18%Cr-8%Ni stainless steel as a basic composition given in Table 1 were melted and cast to form a cast strip having a thickness of 2 mm, by a continuous casting machine having an internal water-cooling twin drum system. The percentage solid phase (percentage columnar crystal) at the time of a release of the cast strip from the drum was controlled to 100 to 60%, through a regulation of the drum gap.

The cast strips were subjected to annealing, pickling, 50% cold-rolling, annealing, and then skinpass rolling with a 1% elongation, to obtain thin sheet products.

COMPARATIVE EXAMPLE 1

For a comparison with Example 1, thin sheet products were manufactured from a cast strip in the same sequence, except that the percentage solid phase was 60% and the cast strip was coiled at 800° C. or 400° C.

With respect to Example 1 (samples A, B, and C) and Comparative Example 1 (samples D and E), the grain size (G.S.N.), elongation, and surface quality of the thin sheet products were evaluated, and the results are given in Table 2.

The thin sheet products manufactured according to the present invention had a product grain size (G.S.N.) of 8.0 or less and an elongation of 50% or more, i.e., sufficiently satisfied the elongation requirement (48% or more), and a satisfactory surface quality from the practical viewpoint, i.e., a roping height of 0.2 μm or less.

By contrast, in Comparative Example 1, which does not meet the coiling temperature requirement of the present invention, although the thin sheets had a product grain size (G.S.N.) of 10.5 (D) and 9.6 (E), i.e., a fine grain structure, and a good surface quality due to this small grain size, the elongation was 43% (D) and 45% (E), i.e., unsatisfactory from the practical viewpoint.

TABLE 1

| | C | Si | Mn | Ni | Cr | Mo | Al | N | O |
|---|---|---|---|---|---|---|---|---|---|
| Process of present invention | | | | | | | | | |
| A | 0.06 | 0.65 | 0.93 | 8.78 | 18.23 | 0.12 | 0.003 | 0.030 | 0.009 |
| B | 0.03 | 0.67 | 0.94 | 10.20 | 18.21 | 0.16 | 0.002 | 0.015 | 0.005 |
| C | 0.05 | 0.48 | 1.01 | 8.45 | 18.62 | 0.20 | 0.003 | 0.032 | 0.005 |
| Comparative process | | | | | | | | | |
| D | 0.05 | 0.50 | 0.98 | 8.00 | 18.36 | 0.11 | 0.003 | 0.030 | 0.004 |
| E | 0.05 | 0.48 | 1.00 | 8.88 | 18.06 | 0.10 | 0.002 | 0.028 | 0.006 |

TABLE 2

| | Coiling temp. (°C.) | Percentage solid phase (%) | G.S.N. | Elongation *(1) | Surface*(2) property |
|---|---|---|---|---|---|
| Process of present invention | | | | | |
| A | 1100 | 70 | 7.2 | ∘(52%) | ∘ |
| B | 1100 | 60 | 8.0 | ∘(51%) | ∘ |
| C | 800 | 80 | 8.0 | ∘(50%) | ∘ |
| Comparative process | | | | | |
| D | 700 | 60 | 10.0 | x (43%) | ∘ |
| E | 400 | 60 | 9.6 | x (45%) | ∘ |

Note:
*(1): The elongation was evaluated as ∘ (acceptable) when the value was 48% or more.
*(2): The surface property was evaluated as ∘ (acceptable) when the roping height of the product sheet was 0.2 μm or less.

EXAMPLE 2

According to the second invention of the present invention, austenitic stainless steels having a basic composition of 18%Cr-8%Ni and comprising various components given in Nos. 1 to 9 of Table 3 were melted and cast into cast strips having a thickness of 2 mm in various atmospheres by an internal water-cooling twin drum casting machine, and the cast strips were held at a temperature in the range of 800° to 1250° C. Then, the cast strips were annealed, pickled, cold-rolled, annealed, and then temper-rolled to obtain thin sheet products. The thin sheets were then subjected to an evaluation of the surface quality and material thereof.

COMPARATIVE EXAMPLE 2

For comparison with Example 2, thin sheet products were manufactured and subjected to an evaluation of the surface quality and material in the same manner as that of Example 2, except that the heat treating condition immediately after the casting, δ-Fe cal or casting atmosphere was outside the scope of the present invention.

The results of the evaluation of the thin sheet products of Example 2 and Comparative Example 2 are summarized in Table 4. As can be seen from this table, the thin sheets (Nos. 1 to 9) manufactured according to the process of the present invention had an excellent material quality and surface quality, whereas the thin sheets (Nos. 10 to 12) manufactured by the comparative process had a poor material quality (elongation) or surface quality (roping).

TABLE 3

| No. | C | Si | Mn | P | S | Cr | Ni | Mo | Cu | Al | N | O |
|---|---|---|---|---|---|---|---|---|---|---|---|---|
| 1 | 0.051 | 0.50 | 0.93 | 0.027 | 0.003 | 18.23 | 8.79 | 0.09 | 0.10 | 0.003 | 0.0302 | 0.0057 |
| 2 | 0.060 | 0.50 | 0.94 | 0.016 | 0.004 | 18.21 | 8.88 | 0.09 | 0.13 | 0.003 | 0.0327 | 0.0069 |
| 3 | 0.053 | 0.48 | 1.01 | 0.018 | 0.001 | 18.31 | 8.68 | 0.01 | 0.07 | 0.003 | 0.0323 | 0.0054 |
| 4 | 0.051 | 0.50 | 0.98 | 0.024 | 0.008 | 18.25 | 8.79 | 0.29 | 0.09 | 0.003 | 0.0304 | 0.0148 |
| 5 | 0.055 | 0.48 | 1.00 | 0.024 | 0.005 | 18.03 | 8.75 | 0.12 | 0.11 | 0.002 | 0.0281 | 0.0025 |
| 6 | 0.050 | 0.49 | 0.98 | 0.014 | 0.002 | 18.24 | 8.67 | 0.13 | 0.12 | 0.003 | 0.0305 | 0.0043 |
| 7 | 0.050 | 0.62 | 1.35 | 0.016 | 0.004 | 22.60 | 13.90 | 0.13 | 0.01 | 0.002 | 0.0281 | 0.0065 |
| 8 | 0.060 | 0.60 | 1.01 | 0.032 | 0.002 | 17.63 | 12.32 | 2.30 | 0.25 | 0.003 | 0.0120 | 0.0096 |
| 9 | 0.030 | 0.60 | 0.90 | 0.030 | 0.003 | 18.30 | 8.40 | 0.16 | 0.21 | 0.002 | 0.0328 | 0.0052 |
| 10 | 0.069 | 0.50 | 0.98 | 0.028 | 0.008 | 18.10 | 10.20 | 0.01 | 0.08 | 0.003 | 0.0306 | 0.0049 |
| 11 | 0.052 | 0.50 | 0.97 | 0.030 | 0.004 | 18.22 | 9.93 | 0.16 | 0.09 | 0.002 | 0.0282 | 0.0065 |
| 12 | 0.061 | 0.50 | 0.94 | 0.030 | 0.003 | 18.43 | 8.67 | 0.16 | 0.21 | 0.002 | 0.0159 | 0.0061 |

TABLE 4

| No. (1) | δ-Fe cal (%) | Cast strip thickness (mm) | Casting atmosphere | Holding condition at 800 to 1250° C. | Amt. of remaining δ-ferrite (%) | Percentage cold rolling (%) | Product properties Surface(2) | Product properties Material(3) |
|---|---|---|---|---|---|---|---|---|
| 1 | 4.56 | 2.5 | $N_2$ | 1100° C. × 10 min | 0.2 | 50 | ∘ | ∘ |
| 2 | 3.22 | 2.3 | $N_2$ | 1100° C. × 10 min | 0.2 | 50 | ∘ | ∘ |
| 3 | 4.36 | 2.3 | $N_2$ | 1100° C. × 10 min | 0.4 | 50 | ∘ | ∘ |

TABLE 4-continued

| No. (1) | δ-Fe cal (%) | Cast strip thickness (mm) | Casting atmosphere | Holding condition at 800 to 1250° C. | Amt. of remaining δ-ferrite (%) | Percentage cold rolling (%) | Product properties Surface(2) | Product properties Material(3) |
|---|---|---|---|---|---|---|---|---|
| 4 | 5.14 | 2.3 | $N_2 + O_2$ | 1200° C. × 3 min | 0.3 | 80 | ○ | ○ |
| 5 | 3.79 | 5.8 | $N_2$ | 1200° C. × 3 min | 0.1 | 80 | ○ | ○ |
| 6 | 4.96 | 4.1 | $N_2$ + Ar | 1200° C. × 3 min | 0.1 | 80 | ○ | ○ |
| 7 | 3.81 | 3.4 | $N_2$ | 900° C. × 60 min | 0.1 or less | 50 | ○ | ○ |
| 8 | 0.40 | 2.3 | He + Ar | 900° C. × 60 min | 0.2 | 60 | ○ | ○ |
| 9 | 7.95 | 2.3 | $N_2$ | 900° C. × 60 min | 2.3 | 85 | ○ | ○ |
| 10 | −1.16 | 2.3 | $N_2$ | 900° C. × 60 min | 0 | 65 | x | ○ |
| 11 | 1.58 | 2.3 | Ar | 900° C. × 60 min | 0.2 | 65 | x | ○ |
| 12 | 4.69 | 2.1 | $N_2$ | none | 4.2 | 65 | ○ | x |

Note:
(1)Nos. 1-9: process of the present invention
Nos. 10-12: comparative process
(2)The surface quality was evaluated based on the occurrence of roping.
○: did not occur
x: remarkable occurrence
(3)The material was evaluated in the L direction
○: good elongation
x: poor elongation

INDUSTRIAL APPLICABILITY

As described above, according to the present invention, in the process for manufacturing a thin strip or sheet through cold-rolling of a cast strip, the control of the casting atmosphere, components and cast strip temperature enables a thin sheet of a Cr-Ni-base stainless steel to be manufactured while ensuring a satisfactory surface quality from the practical viewpoint. This contributes to a realization of a process for manufacturing a thin strip or sheet of a Cr-Ni-base stainless steel which has a much lower production cost and a much higher productivity than the conventional process, wherein a thick cast slab up to about 100 mm is hot-rolled.

We claim:

1. A process for manufacturing a thin strip or sheet of a Cr-Ni-base stainless steel having an excellent surface quality and material quality, which comprises casting a cast strip having a thickness of 6 mm or less from a Cr-Ni-base stainless steel including 18%Cr-8%Ni steel by a continuous casting wherein a casting mold is moved synchronously with the cast strip, and directly subjecting the cast strip to cold-rolling without hot-rolling to form a thin sheet product, wherein the cast strip immediately after the casting is coiled at a temperature of 800° to 1200° C. and subjected to cold-rolling and final annealing to form a thin sheet product.

2. A process according to claim 1, wherein said coiled cast strip is held at a temperature in the range of 800° C. to 1250° C. for 80 min and then subjected to annealing, cold-rolling and final annealing.

3. A process according to claim 1, wherein the casting is conducted in a state such that the percentage solid phase of the cast strip at the time of release from the mold wall is 65% or more.

4. A process for manufacturing a thin strip or sheet of a Cr-Ni-base stainless steel, which comprises casting a cast strip having a thickness of 6 mm or less from a Cr-Ni-base stainless steel including 18%Cr-8%Ni steel and subjecting the cast strip to cold-rolling to form a thin sheet product without conducting hot-rolling, wherein a molten steel comprising said Cr-Ni-base stainless steel is regulated to have a δ-Fe cal (%) of 0 to 10%, said δ-Fe cal (%) being defined by the equation δ-Fe cal (%)=3(Cr+1.5Si+Mo+Nb+Ti)−2.8-(Ni+0.5Mn+0.5Cu)−84(C+N)−19.8 (%), and is cast in an atmosphere mainly composed of nitrogen or helium to form a thin cast strip, held immediately after the at a temperature in the range of 800° to 1250° C. for 80 min or less, and subjected to cold-rolling and final annealing.

5. A process according to claim 4, wherein said thin cast strip after holding at a temperature in the range of 800° to 1250° C. for 80 min is subjected to annealing, cold-rolling and final annealing.

* * * * *

UNITED STATES PATENT AND TRADEMARK OFFICE

CERTIFICATE OF CORRECTION

PATENT NO. : 5,188,681

DATED : February 23, 1993

INVENTOR(S) : S. TERAOKA ET AL.

It is certified that error appears in the above-identified patent and that said Letters Patent is hereby corrected as shown below:

In Col. 3, line 58, after "84" insert --(C+N)- --.

In column 10, line 41, after "the" insert --casting--.

Signed and Sealed this

Twenty-third Day of August, 1994

*Attest:*

*Attesting Officer*

BRUCE LEHMAN

*Commissioner of Patents and Trademarks*